US010208916B2

(12) United States Patent
Kalis et al.

(10) Patent No.: US 10,208,916 B2
(45) Date of Patent: Feb. 19, 2019

(54) CHANNEL BETWEEN HEADLIGHT CHAMBERS

(71) Applicant: Flex-N-Gate Advanced Product Development, LLC, Tehumseh (CA)

(72) Inventors: Edward M. Kalis, Lincoln Park, MI (US); Steve Barman, Canton, MI (US); Charles Schweitzer, Livonia, MI (US); Muhammed A. Hamid, Canton, MI (US)

(73) Assignee: Flex-N-Gate Advanced Product Development LLC, Tecumseh (CA)

( * ) Notice: Subject to any disclaimer, the term of this patent is extended or adjusted under 35 U.S.C. 154(b) by 0 days.

(21) Appl. No.: 15/847,126

(22) Filed: Dec. 19, 2017

(65) Prior Publication Data

US 2018/0172233 A1 Jun. 21, 2018

Related U.S. Application Data

(60) Provisional application No. 62/436,009, filed on Dec. 19, 2016.

(51) Int. Cl.

| | |
|---|---|
| ***F21S 45/20*** | (2018.01) |
| ***F21V 1/00*** | (2006.01) |
| ***F21S 45/47*** | (2018.01) |
| ***F21S 41/32*** | (2018.01) |
| ***F21S 45/10*** | (2018.01) |

(52) U.S. Cl.
CPC ..... *F21S 45/47* (2018.01); *F21S 41/32* (2018.01); *F21S 45/10* (2018.01); *F21S 45/20* (2018.01)

(58) Field of Classification Search
CPC .. F21S 48/145; F21S 48/1233; F21Y 2101/02
USPC ..... 362/509
See application file for complete search history.

(56) References Cited

U.S. PATENT DOCUMENTS

| | | | | |
|---|---|---|---|---|
| 2007/0121336 | A1* | 5/2007 | Chinniah | F21V 15/01 362/507 |
| 2007/0127257 | A1* | 6/2007 | Erion | F21S 41/147 362/547 |
| 2010/0315830 | A1* | 12/2010 | Wan | F21V 29/02 362/547 |
| 2015/0252997 | A1* | 9/2015 | Hamid | H01L 33/648 362/520 |
| 2018/0023778 | A1* | 1/2018 | Gordon | F21S 43/14 362/547 |

FOREIGN PATENT DOCUMENTS

DE 102005060736 B4 11/2008

* cited by examiner

*Primary Examiner* — Ahshik Kim
(74) *Attorney, Agent, or Firm* — Erise IP, P.A.

(57) ABSTRACT

Disclosed is a system for thermally distributing hot air generated in a vehicle headlamp. A channel is defined between different chambers in the headlamp to allow for air circulation, thus reducing hot spots inside the housing around light sources which might compromise internal structures or devices.

13 Claims, 5 Drawing Sheets

CHANNEL BETWEEN HEADLIGHT CHAMBERS

RELATED APPLICATIONS

This application claims the benefit of U.S. Provisional Application No. 62/436,009 filed on Dec. 19, 2016, the entire contents of which are herein incorporated by reference.

BACKGROUND

1. Field

The disclosed systems and processes related generally to the field of vehicle headlight technologies. More specifically, an arrangement is disclosed for the reduction of condensation in a headlamp.

2. Related Art

A very common problem in automotive headlamp arrangements regards the concentration of heat in the internals of the housing, e.g., in the areas around the light sources. For example, a typical modern headlamp incorporates plastics and other materials having temperature maximums—temperatures which should not be exceeded so that internal components will not be compromised, or even fail.

Another relevant problem relating to temperature elevation is the development of water condensate. One primary cause for the condensation is related to the pressure differential created between the inside and outside of the headlamp. Once the one or more light sources in the headlamp heat up once illuminated, the air inside the headlamp housing heats up in the area around the bulb. The elevated temperature will become higher than the air in the outside environment in a particular area of the headlamp. Because of this, water condensate can develop in hotter areas inside the outer headlamp structures that are exposed to the environment, e.g., the one or more lens or lenses.

Conventionally, headlamp arrangements have been developed which vent to the atmosphere in the attempt to reduce the temperature differential between the outside environment and the housing internals. Other arrangements involve the use of moisture-absorbent materials to reduce the condensation.

SUMMARY

Disclosed is a system and a method for more evenly dissipating heat in vehicle lighting systems. In embodiments, a vehicle lighting system includes at least an upper compartment and lower compartment, each of said upper and lower compartments including a forward-facing reflector, the reflector having a reflective front, a back surface, and a bulb; a housing having an interior surface; a channel extending from the upper compartment down into the lower compartment, an upper portion of the channel defined by and between the interior surface of the housing, and the back surface of the reflector in the upper compartment, and a lower portion of the channel defined by and between the interior surface of the housing, and a back surface of the reflector in the upper compartment; and the channel creating a passageway, the passageway enabling the circulation of air between the upper and lower compartments.

In some embodiments, an intermediate compartment is included below the upper compartment and above the lower compartment, the intermediate compartment including an intermediate forward-facing reflector. In some more specific embodiments the intermediate portion of the channel passes through the intermediate compartment and linking the channel between the upper and lower portions, the intermediate portion of the channel defined by and between the interior surface of the housing and a back surface of an intermediate reflector in the intermediate compartment.

In embodiments, the system includes an upper channel portion cross-sectional area taken at about bulb level for the upper compartment; an intermediate channel portion cross-sectional area taken at about bulb level for the intermediate compartment; a lower channel portion cross-sectional area taken at about bulb level for the lower compartment; and the upper and lower portion cross sectional areas are each larger than the intermediate cross-sectional area. In some embodiments, an upper channel portion cross sectional area is taken at about bulb level for the upper compartment, the upper channel cross sectional area may be in the range of about 5,000 $mm^2$-9,000 $mm^2$. An intermediate channel portion total cross sectional area taken at about bulb level for the intermediate channel portion total cross sectional area may be in the range of about 2,000 $mm^2$ to 5,000 $mm^2$; and a lower channel portion cross sectional area is taken at about bulb level for the lower compartment, the lower channel portion cross sectional area may be in the range of about 5,000 $mm^2$ to 10,000 $mm^2$.

In embodiments, the upper channel portion cross sectional area is about 6834 $mm^2$; the total combined intermediate channel portion cross sectional area is about 3934 $mm^2$; and the lower channel portion cross sectional area is about 7010 $mm^2$. The plane ratios for the upper portion, intermediate portion, and lower portion cross sectional areas, in embodiments, are about 1.75 to 1 to 1.75, respectively.

In embodiments, the intermediate portion of the channel is divided into a first branch and a second branch through the intermediate compartment, and the total intermediate channel portion total cross sectional area comprises the sum of a first-branch cross sectional area and a second branch cross sectional area. In more specific embodiments, the first branch cross-sectional area is about 1424 $mm^2$ and the second branch cross-sectional area is about 2509 $mm^2$, and the branching can be used to circumvent other system features, e.g., a light-source housing.

A method is also disclosed. In embodiments, the method is for distributing heat and controlling condensation in a vehicle lighting system where the system has a plurality of compartments. The method may further comprise creating an air passageway between the plurality of compartments by defining a channel into the lighting system, the channel allowing for the circulation of air between an upper compartment and a lower compartment in the plurality.

BRIEF DESCRIPTION OF THE DRAWING FIGURES

DETAILED DESCRIPTION

Figure 1:
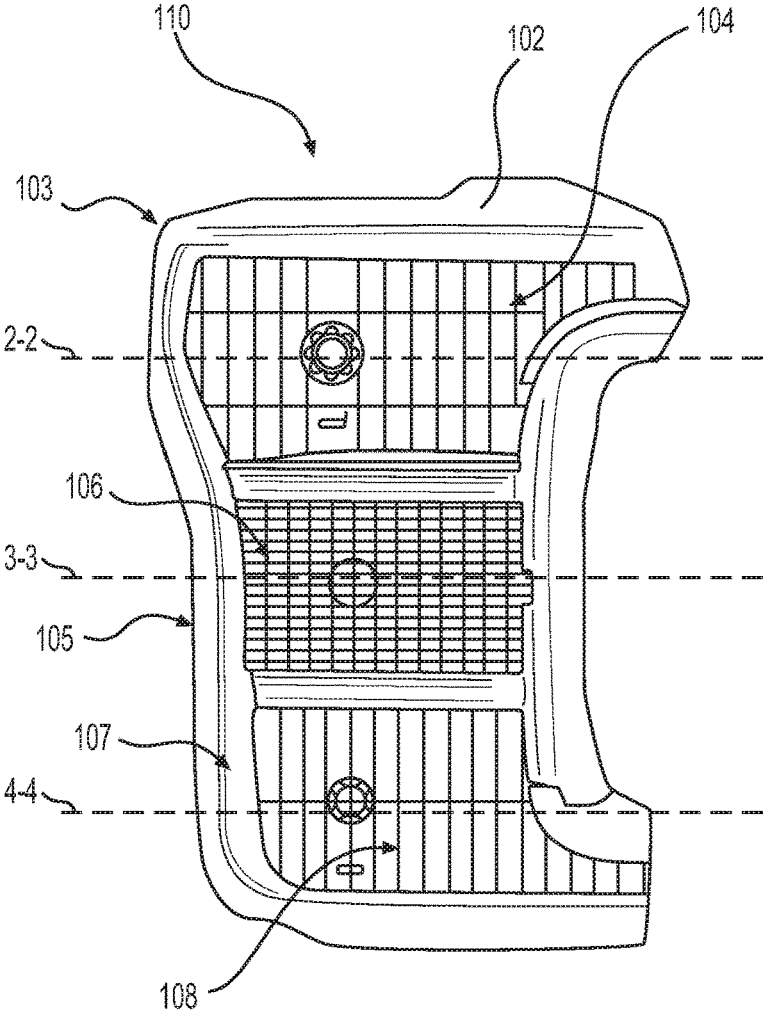
FIG. 1 is a front view of the headlamp.

In the front view of FIG. 1, it can be seen that a headlamp 100 includes a decorative trim bezel 102, an upper reflector and transparent lens 104, a middle reflector and transparent lens 106, and a lower reflector and transparent lens 108.

The headlight is enclosed on the sides and from the back by a housing 110. Housing 110 includes an upper connector 112 and a lower connector 114. Those skilled in the art will recognize that these sorts of connecters are used to secure the headlamp into the adjacent vehicle structures. The headlight 100 also includes a grill receiving area 116. Grill receiving area 116 is where a grill piece for the vehicle front will be received, and thus, the housing portion shown 117 will be concealed after installation.

The bezel 102 and housing 110 collectively form three distinctive compartments. An upper compartment 103 includes the upper housing along with the reflector and transparent lens 104. This compartment is devoted to low beam applications, and thus, reflector 104 is configured to create the appropriate cut lines and other configurations when a low beam is used. Intermediate compartment 105 accommodates the blinker arrangement, and includes middle reflector and lens 106, as well as the middle portion of the housing. The lower compartment 107 accommodates the high-high beam arrangement for the headlamp, and includes the lower housing, reflector, and lens arrangement 108.

Figure 2:
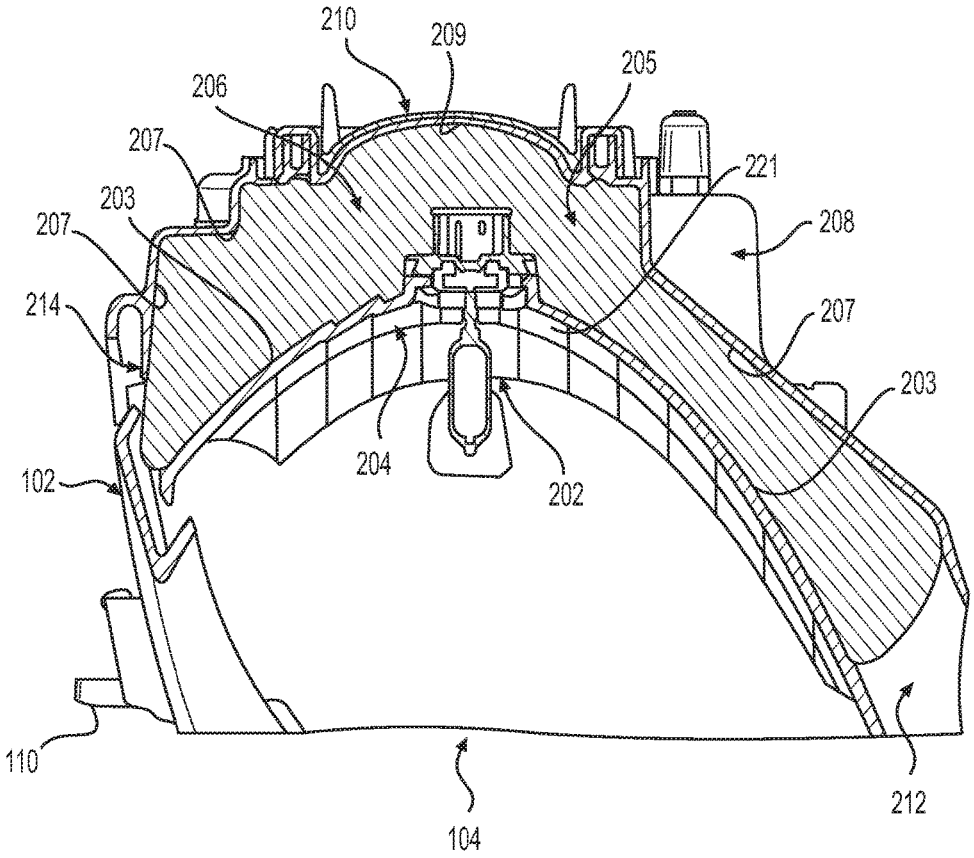
FIG. 2 shows a cross sectional view taken downward from Section 2-2 shown in FIG. 1.

The sectional of FIG. 2 which is the view taken downward and at bulb level from Section 2-2 shown in FIG. 1 reveals some internals in top compartment 103. More specifically, a removable upper bulb 202 fastened into an upper reflector 204 can be seen. Further, an upper portion 205 of a vertically oriented channel 206 is defined between: the back surfaces 203 of the upper reflector 204, internal surfaces 207 of the upper housing 208, the internal surfaces 209 of an access-providing cap 210. Cap 210 configured to be removable to allow access into the housing for the purpose of changing the upper bulb 202. Housing 110 includes laterally-enclosing configurations 212 and 214 which are created to contain the outer regions of the upper portion of channel 206.

The internal configurations of the upper compartment 103 enable the total area of a plane 221 existing at bulb level channel 206 existing in the upper channel 205 is in the range of 5,000 $mm^2$-9,000 $mm^2$. In the embodiment shown in FIG. 2, the total area of the plane 221 in upper channel 205 taken at bulb level is 6834.6 $mm^2$.

Figure 3:
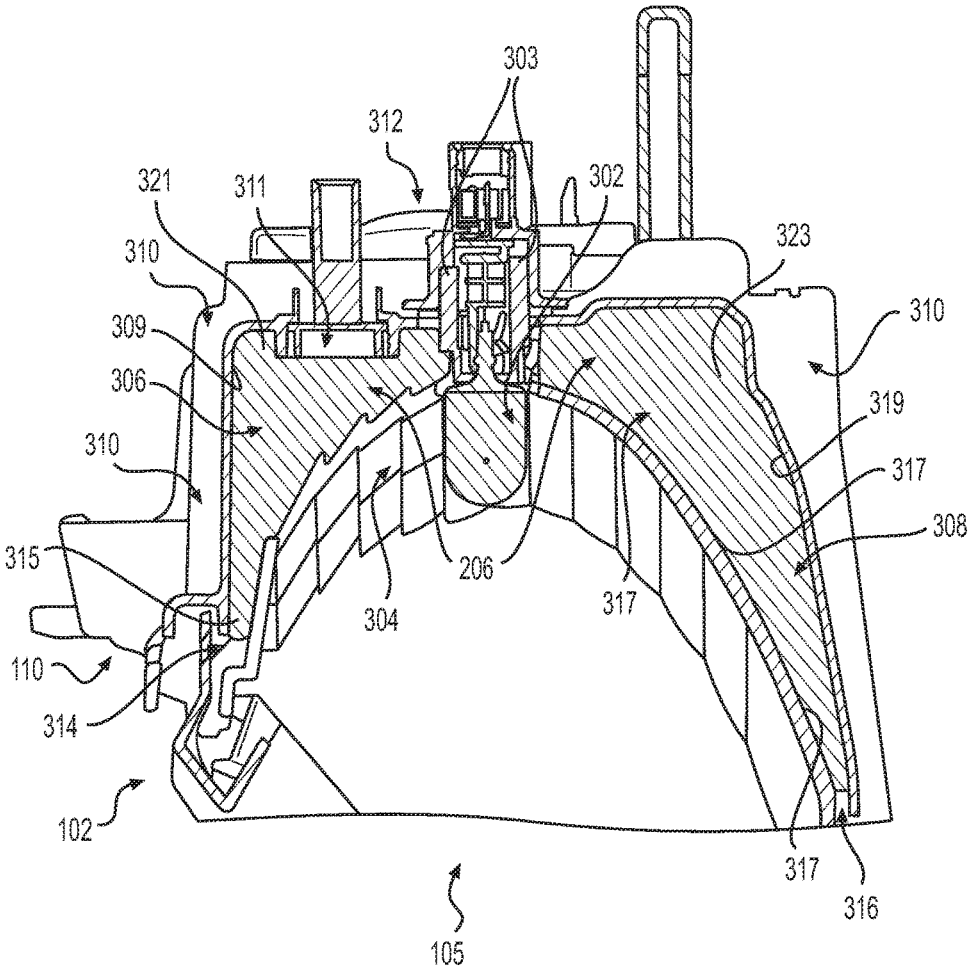
FIG. 3 shows a cross sectional view taken downward from Section 3-3 shown in FIG. 1.

The cross-sectional view in FIG. 3, which is taken at bulb level and downward from Section 3-3 shown in FIG. 1, shows the internals of the middle compartment. A removable middle bulb 302 fastened into a middle reflector 304 can be seen, as well as the configuration of the vertical channel 206 at that point. The vertical channel 206, in the middle compartment 105, splits into branches to form a first-more-exteriorly-oriented subchannel 306, and a second-more-interiorly-oriented subchannel 308. The branching of the channel enables the middle-bulb housing 303 to be circumvented. Branched-apart subchannels 306 and 308, which comprise the intermediate portion of vertical channel 206, are configured to provide considerable air circulation between the upper chamber 103 and the lower chamber 107 without interfering with the structures necessary for bulb 302.

Exterior subchannel 306 is defined by interior surfaces 309 of the mid-housing 310, a fastener head 311, bulb 302, a laterally-enclosing configured portion of the housing 314, and the backside surfaces 315 of reflector 304. Interior subchannel 308 is defined between: the back surfaces 317 of the mid reflector 304, interior surfaces 319 of the mid housing 310, the bulb 302, and a laterally-enclosing configuration of the housing 316.

In the embodiment shown in FIG. 3, the area of plane 321 is 1425.0 $mm^2$, and the area of plane 323 is 2509.5 $mm^2$. The total area including both planes 321 and 323, which is the total passageway area for the combined channel portions 306 and 308 is ideally in the range from 2,000 $mm^2$ to 5,000 $mm^2$. In the embodiment shown in FIG. 3, the total area of the upper channel taken at bulb level is 3934.5 $mm^2$.

Figure 4:
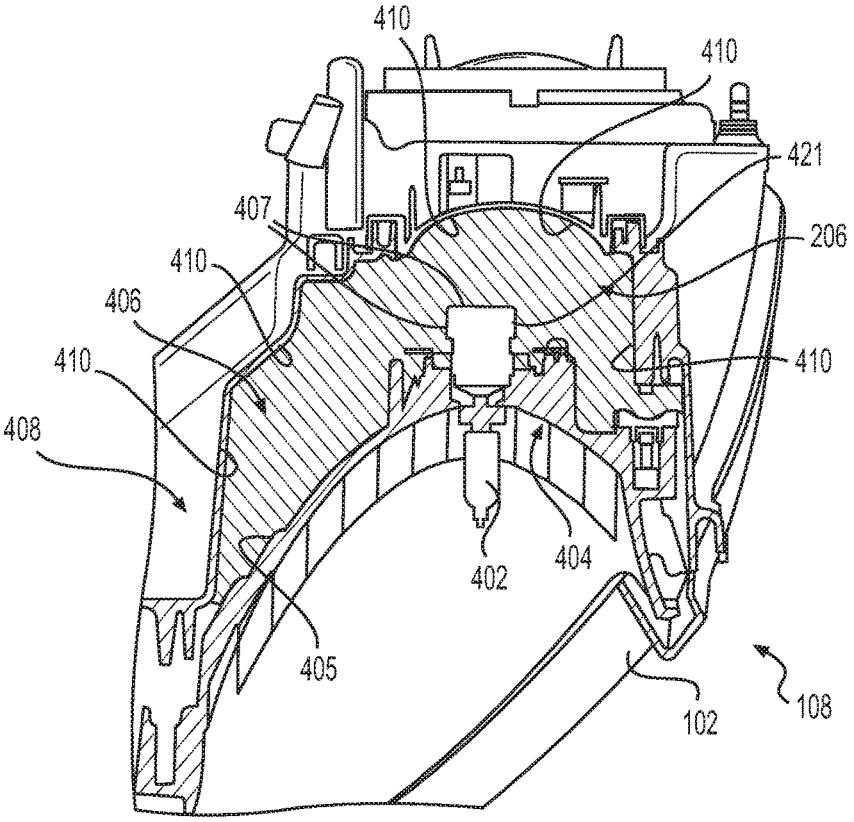
FIG. 4 shows a cross sectional view taken downward from Section 4-4 shown in FIG. 1.
Figure 5:
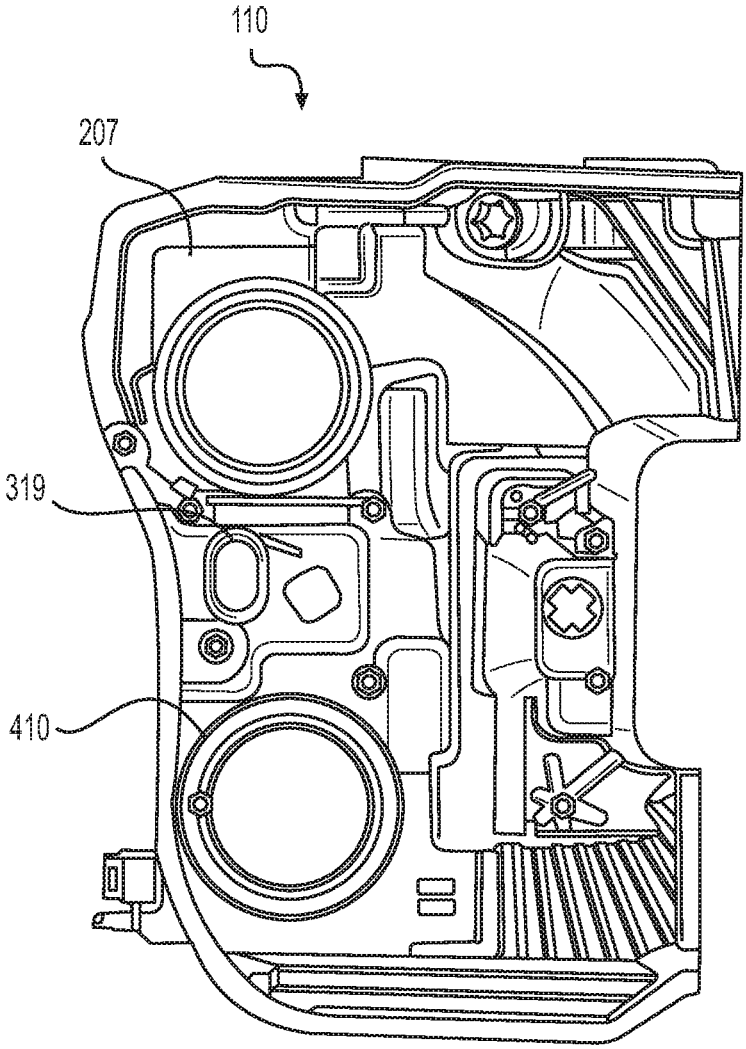
FIG. 5 shows a sectional view taken from a vertical plane normal to the front of the headlamp, the view showing the housing as it appears with the front bezel, lenses, reflectors, and other lighting systems removed.

The sectional of FIG. 4, which is the view in the lower compartment 107 taken downward from Section 4-4 shown in FIG. 1, shows a lower bulb 402 fastened into a lower reflector 404. A lower portion 406 of a vertically oriented channel 206 is defined between: the back side 405 of the lower reflector 404, internal surfaces 410 of the lower housing 408, and side and back surfaces 407 of the bulb 402.

The internal configurations of the lower chamber 107 enable the total area of a plane 421 existing at bulb level in the lower portions 406 of vertical channel 206 to be in the range of 5,000 to 10,000 $mm^2$. In the embodiment shown in FIG. 4, the total area of the plane 421 in lower channel 406 taken at bulb level is 7011.0 $mm^2$.

As can be derived from comparing the values for the cross-sectional areas at each level above, it can be seen that relative to the intermediate portion, the upper and lower channel cross sectional values are both higher. Specifically, the plane ratios for the upper portion, intermediate portion, and lower portion cross sectional areas are about 1.74 to 1 to 1.78, respectively. More generally, a plane ratio for the upper portion, intermediate portion, and lower portion cross sectional areas can be seen as equaling about 1.75 to 1 to 1.75, respectively.

As will be evident to one skilled in the art, each of the cross-sectional areas 221, 321, and 421 are maximized within the surrounding internals. This, the entire channel arrangement (comprising the lower, mid, and upper channel portions) enables significant air transfer (e.g., via natural convection), which provides heat transfer up and down the headlight. This greatly reduces the condensation which would result from the temperature differential between the relatively cool lens and the air inside the housing.

The invention claimed is:

1. A vehicle lighting system for improving internal thermal distribution, the system comprising:

at least an upper compartment and lower compartment, each of said upper and lower compartments including a forward-facing reflector, the reflector having a reflective front, a back surface, and a bulb;

a housing having an interior surface;

a channel extending from the upper compartment down into the lower compartment, an upper portion of the channel defined by and between the interior surface of the housing, and the back surface of the reflector in the upper compartment, and a lower portion of the channel defined by and between the interior surface of the housing, and a back surface of the reflector in the upper compartment; and the channel creating a passageway, the passageway enabling the circulation of air between the upper and lower compartments.

2. The system of claim 1 further comprising:

an intermediate compartment below the upper compartment and above the lower compartment, the intermediate compartment including an intermediate forward-facing reflector; and an intermediate portion of the channel passing through the intermediate compartment and linking the channel between the upper and lower portions, the intermediate portion of the channel defined by and between the interior surface of the housing and a back surface of an intermediate reflector in the intermediate compartment.

3. The system of claim 2 further comprising:

an upper channel portion cross-sectional area taken at about bulb level for the upper compartment;

an intermediate channel portion cross-sectional area taken at about bulb level for the intermediate compartment;

a lower channel portion cross-sectional area taken at about bulb level for the lower compartment; and the upper and lower portion cross sectional areas are each larger than the intermediate cross-sectional area.

4. The system of claim 3 further comprising:

an upper channel portion cross sectional area taken at about bulb level for the upper compartment, the upper channel cross sectional area being in the range of about 5,000 $mm^2$-9,000 $mm^2$;

an intermediate channel portion total cross sectional area taken at about bulb level for the intermediate channel portion total cross sectional area being in the range of about 2,000 $mm^2$ to 5,000 $mm^2$; and a lower channel portion cross sectional area taken at about bulb level for the lower compartment, the lower channel portion cross sectional area being in the range of about 5,000 $mm^2$ to 10,000 $mm^2$.

5. The system of claim 4 wherein the upper channel portion cross sectional area is about 6834 $mm^2$.

6. The system of claim 4 wherein the total combined intermediate channel portion cross sectional area is about 3934 $mm^2$.

7. The system of claim 4 wherein the lower channel portion cross sectional area is about 7010 $mm^2$.

8. The system of claim 2 further comprising:

a plane ratio for the upper portion, intermediate portion, and lower portion cross sectional areas being about 1.75 to 1 to 1.75, respectively.

9. The system of claim 4 wherein the intermediate channel portion is divided into a first branch and a second branch through the intermediate compartment, and the total intermediate channel portion total cross sectional area comprises the sum of a first-branch cross sectional area and a second branch cross sectional area.

10. The system of claim 9 wherein the first branch cross-sectional area is about 1424 $mm^2$ and the second branch cross-sectional area is about 2509 $mm^2$.

11. The system of claim 9 wherein the intermediate portion of the channel is divided to branch around a light-source housing.

12. A method for redistributing heat in a vehicle lighting system, the lighting system having a plurality of vertically-oriented compartments in a housing, each of the compartments including a reflector, the method comprising:

creating an air passageway between the plurality of compartments by defining a channel in a space behind an interior surface of the housing and a rear surface of each reflector, the channel extending between each of the vertically-oriented compartments, thus allowing for the circulation of air between all of the plurality of vertically-oriented compartments.

13. An air flow channel in a lighting assembly housing, comprising:

an upper compartment housing a first bulb and reflector arrangement;

a lower compartment housing a second bulb and reflector arrangement;

each of the upper and lower compartments presenting interior housing surfaces;

at least one channel fluidly coupling the upper compartment with the lower compartment, thereby enabling air flow between the upper and lower compartments the airflow occurring between the back of each reflector and the interior housing surfaces for preventing localized hot spots due to entrapment of hot air in one of the upper compartment or the lower compartment.

* * * * *